United States Patent [19]

Laakso

[11] 4,000,063

[45] Dec. 28, 1976

[54] APPARATUS FOR SEPARATING KNOTS FROM PULP

[75] Inventor: Oliver A. Laakso, Glen Falls, N.Y.

[73] Assignee: Kamyr, Inc., Glens Falls, N.Y.

[22] Filed: Mar. 28, 1975

[21] Appl. No.: 563,171

Related U.S. Application Data

[62] Division of Ser. No. 339,759, March 12, 1973, Pat. No. 3,886,035.

[52] U.S. Cl. ..... 209/233; 209/262; 209/304; 209/359; 209/106

[51] Int. Cl.[2] ..... B07B 1/00

[58] Field of Search ..... 209/270, 273, 233, 303, 209/304, 271, 106, 279, 280, 268, 359, 360, 361, 309, 262

[56] References Cited

UNITED STATES PATENTS

| | | | |
|---|---|---|---|
| 553,945 | 2/1896 | Torrance | 209/304 |
| 1,841,079 | 1/1932 | Barr | 209/273 |
| 2,748,941 | 6/1956 | Fontein | 209/274 |
| 2,966,267 | 12/1960 | Dunbar | 209/271 |
| 2,973,093 | 2/1961 | Erickson | 209/106 |
| 3,219,187 | 11/1965 | Ritze | 209/233 |
| 3,245,535 | 4/1966 | Cowan | 209/273 X |
| 3,626,664 | 12/1971 | Hoffstrom | 209/233 |

*Primary Examiner*—Robert Halper
*Attorney, Agent, or Firm*—Cushman, Darby & Cushman

[57] ABSTRACT

An improved system for the production of digested pulp from wood chips and knots which includes a separating apparatus, connected to the digester output, capable of separating knots from partially cooked wood chips and fibers at the digester pressure and consistency. The separated fibers and fiber bundles pass to a refiner where the fiber bundles are mechanically reduced to fibers in a liquid environment at a high consistency and at the digester pressure. The knots are then re-cycled to the digester or other processes.

The separating apparatus above uses a plurality of rotating members such as intermeshing screws or grooved rolls, arranged in a vertical screen to separate an inlet chamber from an outlet chamber. Knots cannot pass through the rotating members and thus are driven out of an outlet which communicates with the inlet chamber. The fibers, however, do pass through the rotating members to the outlet chamber and exit therefrom by a second outlet.

6 Claims, 8 Drawing Figures

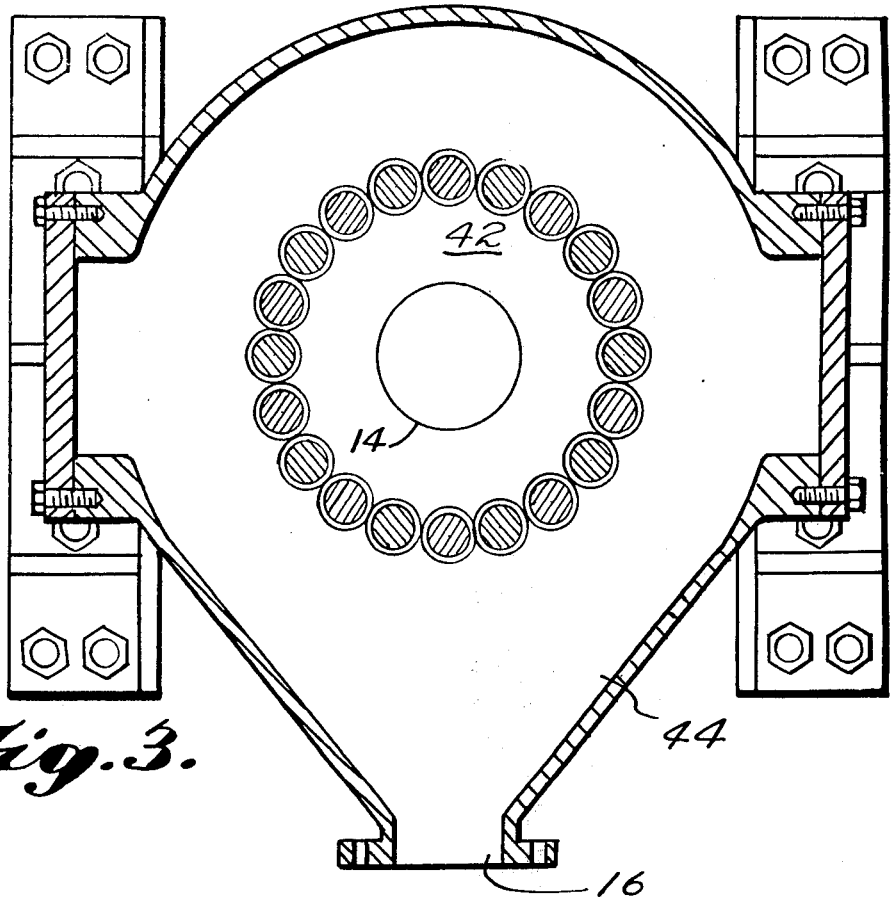
Fig. 3.
Fig. 7.
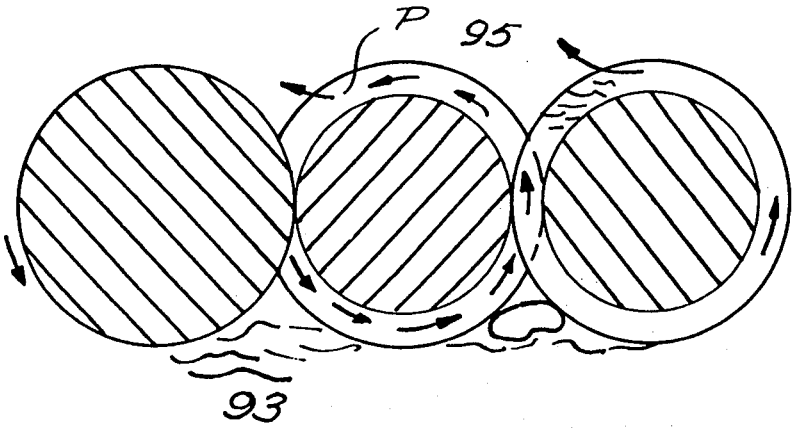

APPARATUS FOR SEPARATING KNOTS FROM PULP

This is a division of application Ser. No. 339,759 filed Mar. 12, 1973, now U.S. Pat. No. 3,886,035.

BACKGROUND OF THE INVENTION

This invention relates to process and apparatus for removing undigested knots and the like from digested cellulosic pulp.

DESCRIPTION OF PRIOR ART

Pulp cooking processes are well known in which a charge of wood chips which includes knots and other large impurities is subjected, in a digester, to a digesting liquor which chemically reduces most of the wood chips to their constituent fibers. Further, it is known to wash these fibers in the digester with water to remove at least a portion of the digesting liquor therefrom and to form a pulp of water, fibers, fiber bundles and knots. It is also known to remove the knots from said pulp in a separating apparatus and to feed the pulp to a refiner to mechanically break down those fiber bundles which had resisted the digesting liquid.

Until recently, the pulp leaving from the digester at a solids content of approximately 10–15% had to be greatly diluted with water prior to the refining or separating apparatus. Water dilution was necessary before the refiner because the amount of digesting liquor which remained with the pulp issuing from the digester caused damage to the fibers in conjunction with the mechanical action of the refiners. Thus the water dilution was necessary to reduce the percentage of active digesting liquor passing through the refiner with the pulp to a safe level.

A recently developed digester is shown in the U.S. Pat. No. 3,298,899, to Laakso, issued Jan. 17, 1967. This digester produces a pulp having a safe level of active digesting liquor, for example, 0.05 pounds of active digesting liquor per cubic foot of pulp and thus eliminates the need of water dilution for the refiners.

This elimination of water dilution of the pulp presents a great improvement in the pulp digesting process since it eliminates the need for a relatively large throughput of water. For example for a 500 ton per day pulp digesting plant requires 4850 gpm of water to dilute 1000 gpm of pulp from a solids content of 15% to a solids content of 3%.

In addition, since the solids content must be returned to a level of about 10–15% prior to further process steps, this diluting water must be removed in a screen room, which is a very costly piece of equipment. A screen room for a 500 ton per day plant would cost at least two million dollars at present day costs.

All of the advantages which are gained by eliminating the diluting water and screen room for the refining step, are negated, however, if dilution is necessary prior to the step in which the knots are separated from the pulp. Unless the pulp digesting process was one in which knots were acceptable i.e., making unbleached paper, the prior art required knot removal by the separating apparatus which was of the screen type and required dilution to about 3% solids content or less to avoid clogging of the screens.

SUMMARY OF THE INVENTION

In view of the above-stated deficiencies of the prior art, the principal object of the present invention is to provide a pulp digesting system for producing bleachable pulp which requires very little, if any, dilution of the pulp leaving the digester. It is therefore a principal object of this invention to provide a separating apparatus which can separate knots and other large impurities from high density pulp without becoming clogged.

According to the invention, the objects thereof are realized by the provision in a pulp digesting system of a separating apparatus comprising a separating chamber, a screen comprising a plurality of closely spaced helically threaded intermeshing screws or peripherally contacting rolls having cooperating grooves, positioned vertically in the chamber, and dividing the chamber into inlet and outlet sections, a pulp supply inlet for supplying pressurized pulp from a digester into the inlet section of the chamber, means for rotating all of the screws or rolls in the same direction for feeding the pulp in cooperation with the pulp pressure through the screws or rolls to a pulp outlet and means for discharging the knots and other large impurities which do not pass through said screws or rolls from a knot outlet.

The use of the separating apparatus thus described in connection with a refiner which operates downstream of the separating apparatus but also at essentially digester pressures and pulp consistencies eliminates the need for large diluting and re-concentrating equipment.

BRIEF DESCRIPTION OF THE DRAWINGS

The invention is more fully described hereinafter in connection with the accompanying drawings wherein:

FIG. 3 is a top view of the separating apparatus along the line 3—3 shown in FIG. 2;

FIG. 7 is a view of the separating apparatus shown in FIG. 5 showing the action of the screw threads;

DETAILED DESCRIPTION OF THE DRAWINGS

Figure 1:
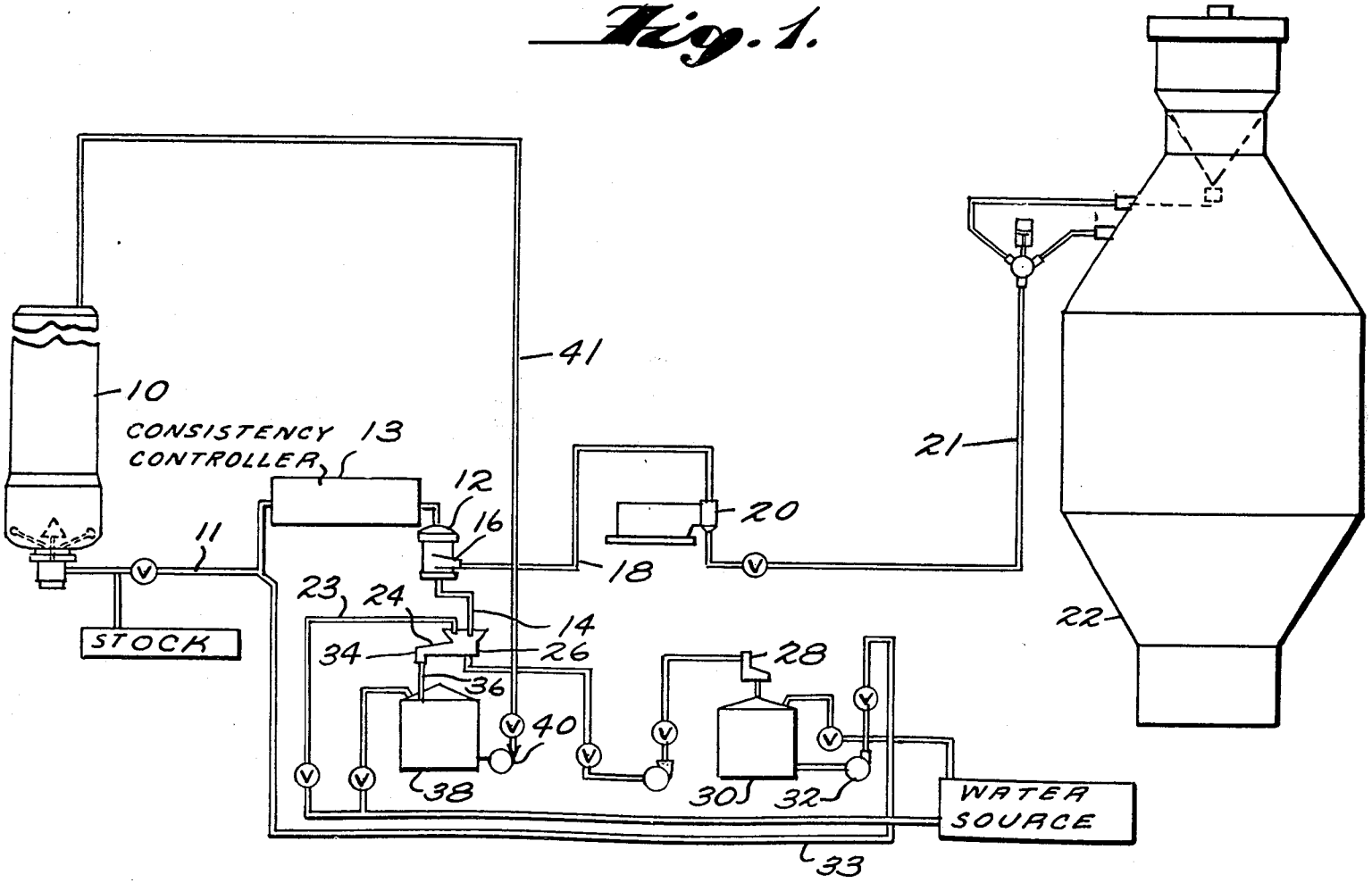
FIG. 1 is a schematic view showing a system for digesting pulp including the separating apparatus of this invention.

FIG. 1 shows a portion of a plant for processing wood chips into pulp. According to well known processes, the wood chips, which also include knots or the like, are introduced into a pre-impregnation vessel (not shown) where they are impregnated with the digesting liquor and then circulated via a pump (not shown) to digester 10 where most of the chips are reduced by the digesting liquor to their constituent fibers and washed with water to remove the digesting liquor. Continuous digesters of the type now in large scale use produce a relatively high density pulp containing from 8–15% fiber solids. This pulp usually includes a minor percentage of undigested particles, mostly knots, which have to be removed to obtain a high quality paper product. Further, digesters with improved wash cycles, such as are described in the aforementioned patent produce pulp which contains very little active digesting liquor, for example, about 0.05 pounds per cubic foot, and thus this pulp may be passed directly to a refiner without a prior dilution to reduce the digesting liquor content to a safe level.

According to the invention, knots and relatively large, unreduced particles are removed without diluting the pulp by the separating apparatus 12. To this end, the pulp issuing under pressure from digester 10 which may be about 440 tons/day in volume is fed by the digester pressure of about 150–250psig to the separating via conduit 11 and a conventional consistency controller 13.

Separated knots, and the like are discharged from outlet 14 located at the bottom of the separating apparatus 12 at the volume of about 88 ton/day while the accepted pulp is discharged at outlet 16 at the volume of about 352 ton/day. From outlet 16 the pulp may be passed by conduit 18 to refiner 20 which is employed to mechanically remove any shives or fiber bundles which pass through the separating apparatus 12 with the pulp. The refiner does not encounter knots or the like because these were removed upstream at the separating apparatus 12 and thus the effluent from the refiners is a clean pulp consisting almost solely of individual fibers which are capable of forming high grade paper.

The pulp exiting from the refiner 20 is fed to a stock storage receptacle 22 through the stand pipe 21 where it is stored as base stock for use in the paper making process. The combination of the pressure on the inlet side and the head pressure of the stand pipe 21 insures that the refiner always operates wet, i.e., that the refining action always takes place in a liquid state where forces applied to the edge of the fiber bundles are transferred by the incompressible liquid to all portions thereof. Thus, a more efficient refining action is provided in addition to a more efficient separating action.

The knots and the like and the small amount of rejected pulp which pass from the separating apparatus 12 through the outlet 14 are diluted by water from conduit 23 to a solids content less than 7% and generally about 11–14%. This slurry of knots, water and some pulp is then fed to the conventional gravity knotter 24 in which the pulp is fed through a screen while the knots are rejected and fall over a spillway. The accepted pulp then passes from outlet 26 of knotter 24 to a standard thickener 28 where the pulp consistency is increased to about 6.5% solids content. This thickened pulp next passes to the recycle tank 30 where it is stored prior to recycling.

When it is desired to recycle the pulp, pump 32 is energized and the pulp is pumped through conduit 33 which joins conduit 11 upstream of the consistency controller 13.

The knots which are rejected by gravity knotter 24 pass through the outlet 34 of the knotter 24 and fall through conduit 36 into the knot storage tank 38 where they are stored at a solids content of about 3.5% prior to recycling. The knots are recycled by pump 40 and conduit 41 to the digester 10. The knots are usually broken down by the digesting liquor to their constituent fibers on a second pass through the digester.

Of course, the dilution required by the gravity knotter 24 somewhat offsets the advantage gained by eliminating the dilution for separating apparatus 12 and refiner 20. However, it must be noted that less than 10% of the water required for dilution in conventional systems is required by the present system because only 20% of the total pulp flow needs to be diluted (88 ton/day as against 440 tons/day).

Turning to the separating apparatus 12 several preferred embodiments of this apparatus will now be described.

Figure 2:
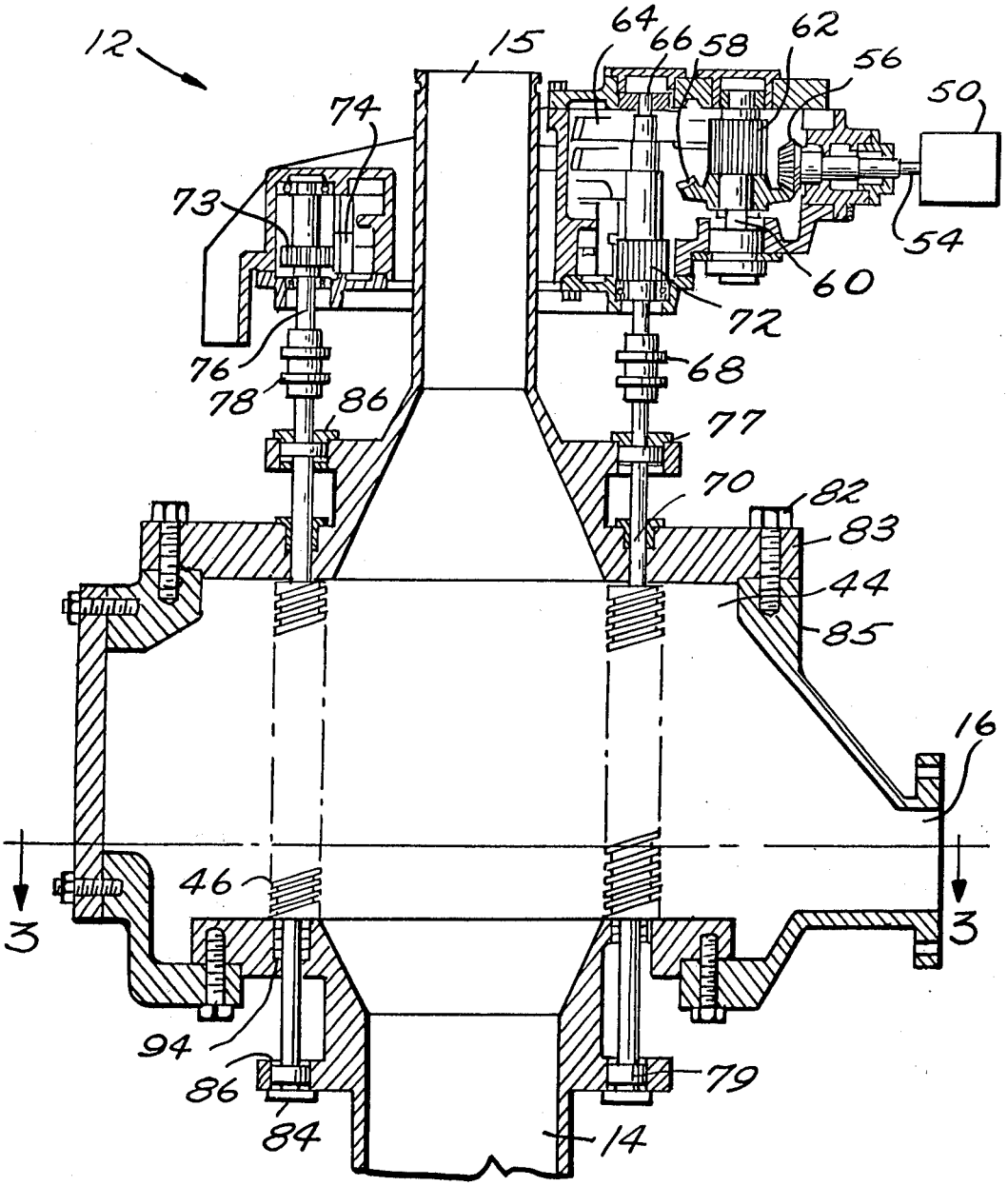
FIG. 2 is a front sectional view along the center line of the separating apparatus shown in FIG. 1.

In a first embodiment the separating apparatus is divided into an inlet chamber 42 and an outlet chamber 44 by a circular ring of grooved rolls 46 as is best seen in FIGS. 2 and 3. The pulp and knots enter from the conduit 11 through the inlet 15 at the top of the separating apparatus 12 at a flow rate of about 1000gpm or 440 tons/day. Most of the pulp passes between the grooved rolls under the digester pressure of between 150–250 psig which is transferred via conduit 11 (minus normal friction losses) to chamber 42 which is always kept completely full of liquid and pulp.

The knots and that portion of pulp not passing through the grooved rolls 46 pass, under the combined force of gravity and digester pressure, to outlet 14 of the separating apparatus 12 and are expelled therefrom.

The accepted pulp, on the contrary, enters the annular outlet chamber 44 which surrounds the ring of rolls and is forced therefrom, out through outlet 16 under the pressure of fresh pulp which continually enters this area.

Figure 4:
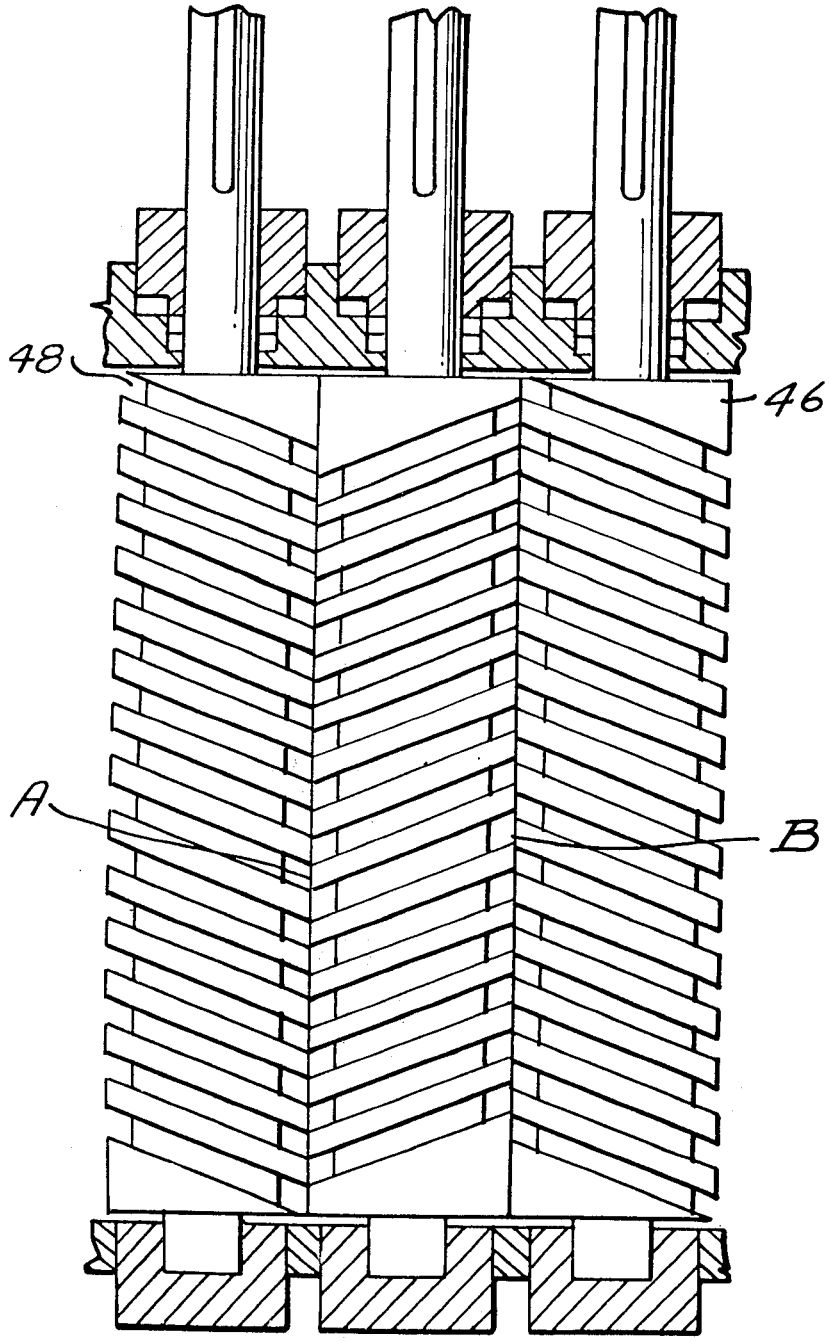
FIG. 4 shows the grooved rolls which are shown in FIG. 2.

As can best be seen in FIG. 4, the grooved rolls 46 contact each other at their peripheries. Each grooved roll contains a plurality of square cut grooves 48 which are separated by ridges. The grooves are disposed at an angle of about 20° with respect to the horizontal plane.

In addition, the rolls 46 are so arrangd that the grooves 48 of adjacent rolls 46 are in register with ridges which define the grooves of the adjacent rolls. Thus, when the rolls 46 are rotated in a uniform direction the pattern of grooves 48 at the point of contact between adjacent rolls 46 will change from the pattern shown at A in FIG. 4 to that shown at B and then back that shown at A. It is therefore seen that the grooved rolls 46, during rotation, produce an oscillatory motion at the face of the rolls which keeps the plurality of rolls from being clogged by a film of knots while the grooves 48 provide access for pulp to enter the outlet chamber and the rotary movement of the rolls 46 helps to draw pulp through the grooves.

The rolls are powered, for example, by a standard 30hp electric motor 50 and which is connected to an input shaft 54. A bevel gear 56 is attached to the end of the input shaft 54 and this gear is in meshing engagement with the ring gear 58 which is mounted upon shaft 60 to transfer power to said ring gear. Also, mounted upon the shaft 60 is the gear 62 which, in turn, transfers power to the gear 64 mounted upon the main drive shaft 66.

The main drive shaft 66 powers one of the rolls 46 through coupling 68, and packing ring 70. Shaft 66, like all the other shafts 76 discussed below, is journalled by conventional roller bearings 77 and all the rolls 46 are similarly journalled by bearings 79.

The shaft 66 also has mounted thereupon a gear 72 which is in meshing engagement with the bull gear 74. The bull gear 74, is mounted for rotation about the axis of the inlet 15 and inlet chamber 44 of the separating apparatus 12. The bull gear 74 also is in meshing engagement with a plurality of gears 73 which are similar to gear 72. The other gears 73 are, in turn, mounted upon journalled stub shafts 76 which are each connected through separate coupling means 78 and separate packing rings 86 to separate rolls 46. In all, there are about 20 such rolls and they are arranged on a ring having the inlet axis as its axis, but more or less may be used depending on the size of rolls 46 and the capacity of separator 12.

The above described drive system provides an efficient way to rotate all the rolls 46 in a common direction since no motion is lost in chain or pulley drives. In addition, the circular arrangement of the rolls provides for a maximum separating surface within the area of the separating apparatus.

When it is desired to remove the rolls and drive system, one need only to perform the following operations:

a. disconnect the inlet 15 of the separating apparatus for conduit 11;

b. unscrew the bolts 82 which connect the top cover 83 of the separating apparatus 12 including the drive system to the remainder thereof 85.

c. remove bearing shields 84 from the bearing housing 86 located at the bottom of each roll 46;

d. remove the retaining nuts, the bearings and the bearing retaining rings from the bottom of each roll (not shown);

e. remove the packing (or mechanical seals) from the packing boxes 94 at the bottom of each roll 46, and f. lift the entire top part 83 from the remainder 85.

Figure 5:
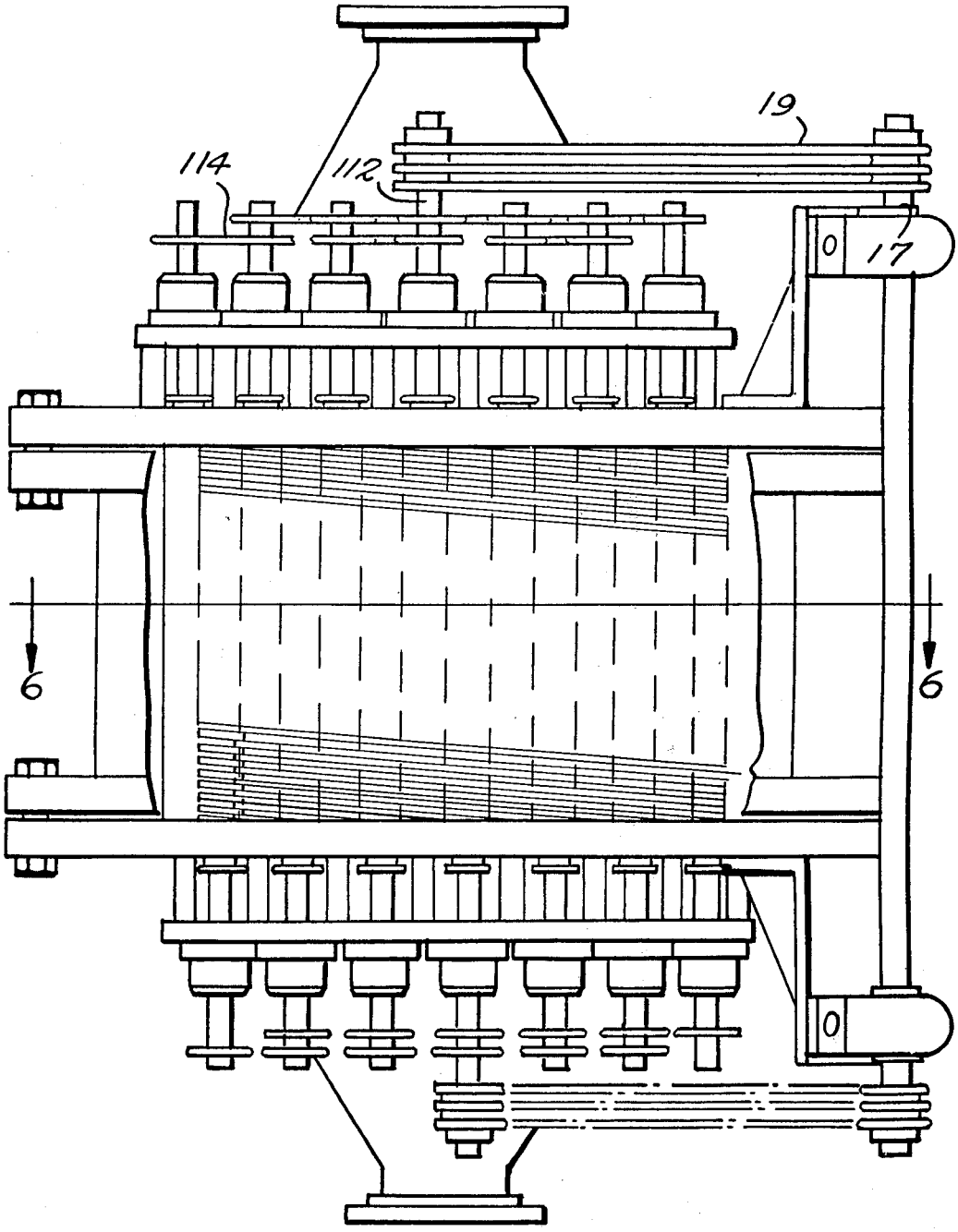
FIG. 5 is a view similar to FIG. 2 but showing another embodiment of the separator.
Figure 6:
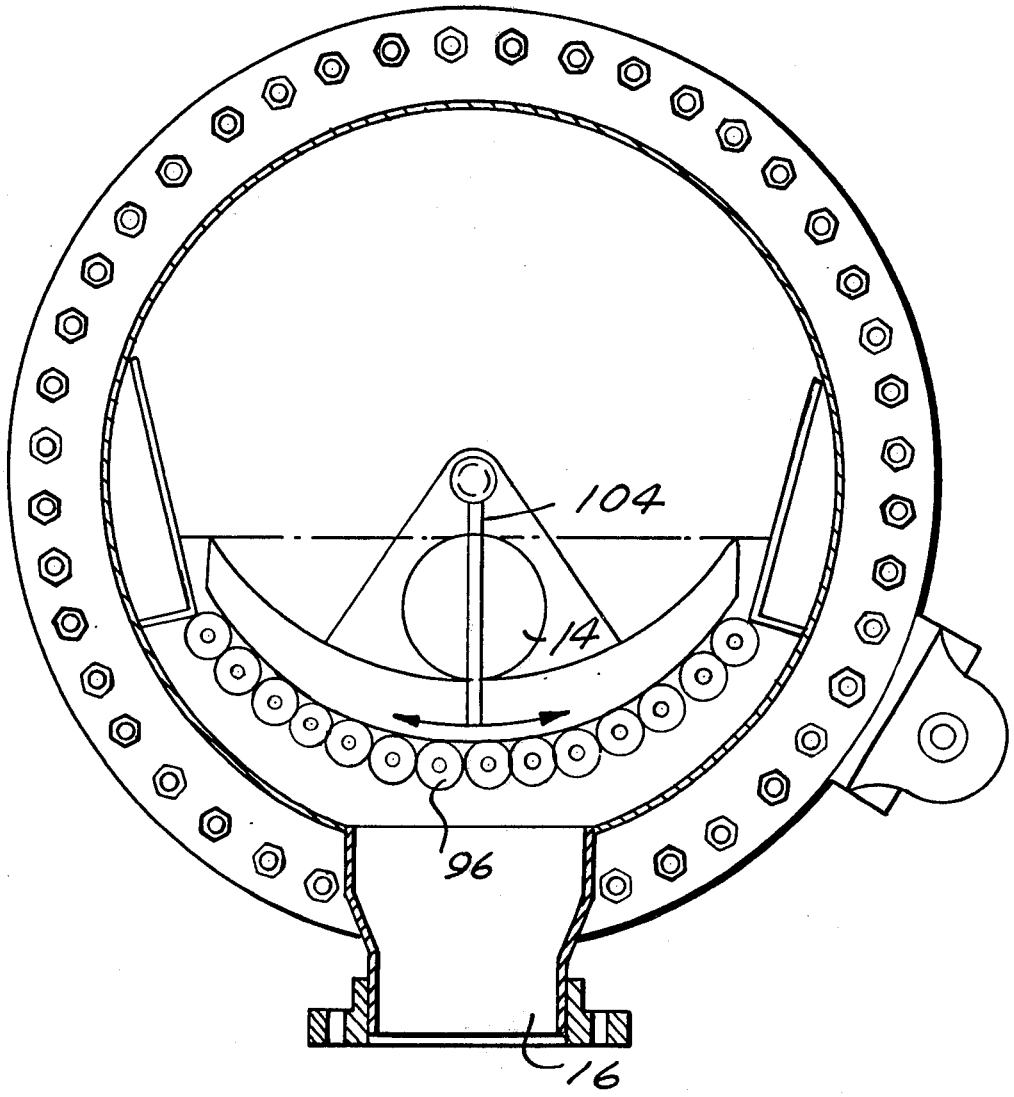
FIG. 6 is a top view along the line 6–6 of FIG. 5.
Figure 8:
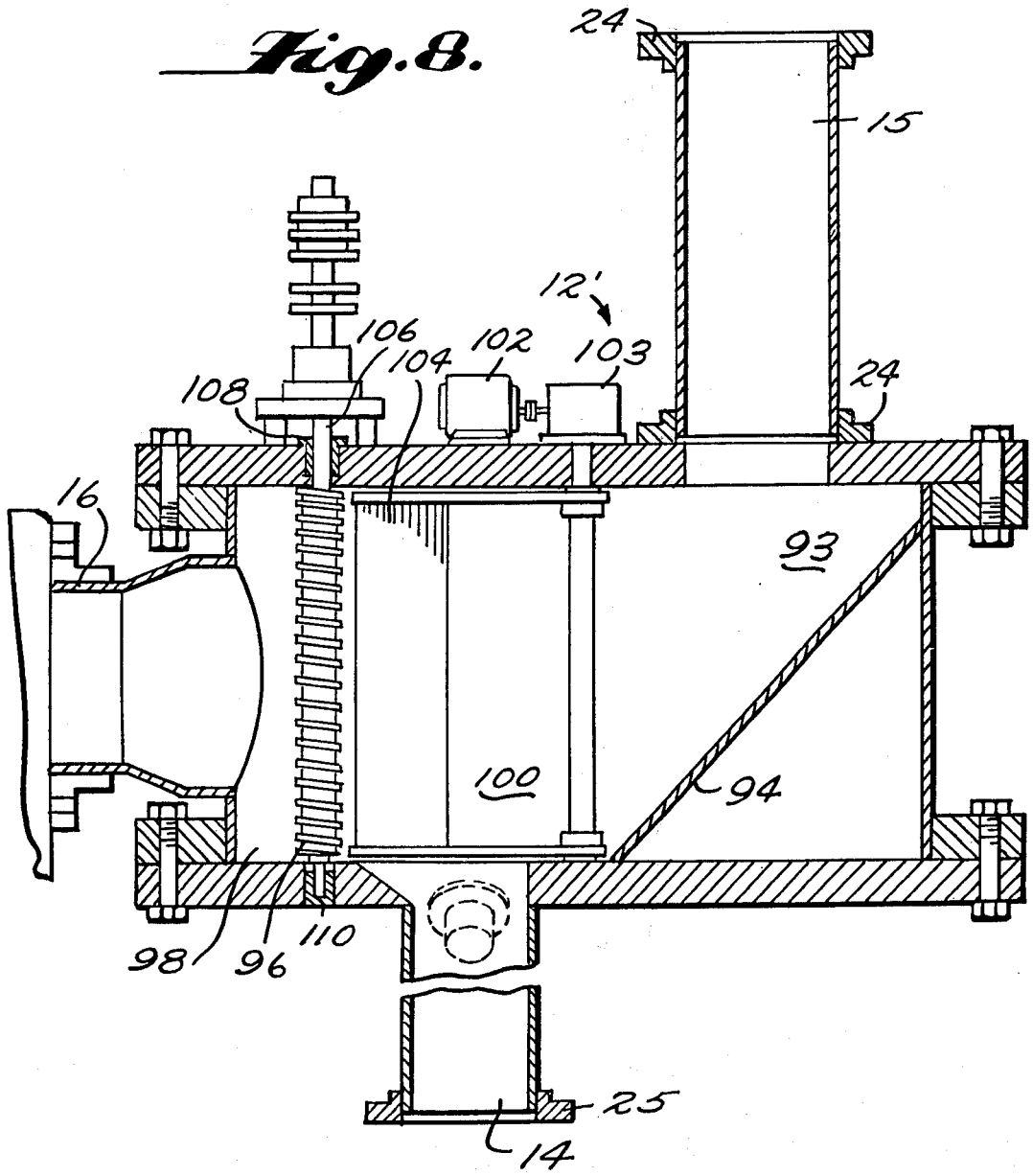
FIG. 8 is a sectional side view of FIG. 5 showing an optional feature.

Having described one preferred embodiment of the invention, reference is now made to another embodiment which is shown in FIGS. 5, 6 and 8. As is perhaps best seen in FIG. 8, the pulp enters the inlet chamber 93 of the separating apparatus 12 through inlet 15 from the conduit 11 at about 1000gpm, here the pulp is deflected by the baffle, 94 from a vertically downward to a horizontal path and encounters the plurality of intermeshing screws 96 which are disposed in a semicircle. The screws divide inlet chamber 93 from outlet chamber 98. Most of the pulp passes through the screws 96 by means discussed in detail below at a rate of about 850gpm while all the knots and some pulp pass out through the knot outlet 14 at a rate of about 150gpm. The accepted pulp leaves the separating apparatus 12 by the pulp outlet 16.

A mechanical agitator 100 of a generally "windshield wiper" type shape is oscillated by motor 102 and transmission 103 to cause the agitator blade 104 to continually sweep to the area adjacent the screws to thereby avoid a knot build-up thereupon.

The screws 96 are each mounted on separate shafts 106 and the tops of these shafts protrude outwardly from the separating apparatus 12' through packing means 108 while the bottoms of the shafts are rotatably mounted in bearings 110 (shown in FIG. 8). A vertically disposed central drive shaft 112 is also provided and connected to the other shafts by chains 114 which rotate all the screws 96 in a common direction. The central shaft is powered by a motor (not shown) which rotates shaft 17 and the chain 19. The shafts are rotated at the speed of between 75 and 150 rpm.

As is also apparent in FIG. 8, inlet 15 and outlet 14 are secured by means of flanges 24 and 25, respectively, and the outlet 16 is welded to the separating apparatus 12'. Thus the entire separating apparatus may be disassembled without disconnecting the outlet flanges.

Because all the screws rotate in one direction there is no tendency of counter-rotating screws to pull a large impurity therethrough and thus damage the screws and jamming of the apparatus is avoided. Further, since the helical screw threads have a slight downward pitch of approximately 20°, the effect of gravity upon the knots is aided and the knots are literally driven down toward discharge 14.

As is best seen in FIG. 7 the pulp is pushed through the interstices between the rotating screws by the digester pressure of inlet chamber 93 while the knots are carried downward by the screws. The rotating screw threads help to feed the pulp through the interstices between the intermeshing screws by providing a surface which continuously moves from the inlet to the outlet section. Of course, the surface also moves continuously from the oulet to the inlet sections as well, but when a point P upon the screw thread begins to rotate back into the inlet section, the higher pressure existing in the inlet section strips the pulp from the thread thus freeing it to receive a new load of pulp in the inlet section.

Thus the relatively small pressure drop across the row of screws which may be approximately 10 psia aids the operation of the separating apparatus 12 and 12'.

Moreover, the degree of intermeshing between adjacent screws may be varied from a minimum overlap when the outer diameter of the screws just touch to a maximum overlay in which the pressure drop across the screws becomes excessive due to the limitation of the area through which the pulp may flow.

While the above description covers the operation of the system and two preferred embodiments of the separating apparatus used therein, many modifications to this basic system are possible within the scope of the invention.

Thus in the embodiment of FIG. 8 more than one row of meshing screws might be used or the meshing screws might be arranged horizontally with respect to their longitudinal axes though the row of screws would still be vertical. Additionally, the meshing screws might be angled 5 – 45% from vertical to aid the gravity separation of the knots. It is also obvious that the screws could be in a straight row forming a vertical plane rather than a semicircle. Also the structure and position of the mechanical agitator may be varied.

In a still further modification to the second embodiment the rotating screws 96 are replaced by grooved interacting rolls identical to the one described with respect to the first embodiment. In this case the mechanical agitator could be removed since the oscillating action of the rolls would prevent any knot accumulation.

Similarly, in the firt embodiment, the grooved rolls could be replaced with meshing screws as described with respect to the second embodiment.

With respect to the system, it is not imperative that the separating apparatus be followed by a refiner. It is possible that another apparatus could follow the separating apparatus.

Finally, it is not essential to recycle the separated knots to the digester. These knots may be passed directly to other process equipment where they can be used as the base stock in a process for making, for example, corrugated cardboard boxes.

What is claimed is:

1. Apparatus for separating knots and other large undigested particles from partially digested wood chips and fibers all of which for the solids portion of a pressurized pulp having a solids content of about 10–15% by weight, comprising a chamber, a source of pulp under high pressure of about 150–250 psig disposed on one side of said chamber and connected thereto by an inlet to said chamber, a plurality of rotatable members rotatable about generally vertical axes disposed in said chamber and arranged in a single continuous row across said chamber, said members forming a screen with apertures smaller than said knots for separating said knots from said partially digested wood chips and fibers, said rotatable members comprising rolls which are in contact at their peripheries, means associated with said rotatable members for forcing said knots downwardly to a knot outlet disposed in communication with said inlet on one side of said screen formed by said rotatable members and below said rotatable members adjacent the bottoms thereof, means associated with said rotatable members for preventing the clogging of the apertures therebetween as a result of continued operation of the apparatus, said means associated with said rotatable members for forcing said knots downwardly and for preventing the clogging of apertures therebetween comprising a plurality of distinct grooves formed upon the circumference of each of said rolls and inclined with respect to the axis of rotation of said rolls and in registry with the grooves of adjacent rolls at plural points of registry so that when said rolls are rotated said points of registry are oscillated in a plane parallel to the axes of rotation of said rolls, means for rotating all of said rotatable members in the same direction, and a pulp outlet disposed on the opposite sides of said screen formed by said rotatable members of said inlet, the high pressure of about 150–250 psig behind said pulp forcing the portion of said pulp not separated by said screen through said knot outlet, that portion of said pulp separated by said screen passing through the pulp outlet.

2. The separating apparatus as recited in claim 1 wherein said means for rotating said rotatable members comprises a plurality of pinion gears, one connected to each roll, a bull gear driving each of said pinion gears, a gearing system for driving said bull gear and a motor connected to said gearing system for providing power to said bull gear.

3. The separating apparatus as recited in claim 1 wherein said rotatable members and said means for rotating said rotatable members are supported by a member which forms the top of said chamber, and said top member is releasably connected to the bottom portion of said chamber so that said rotatable members and said means for rotating same may be easily removed from the bottom portion of said member.

4. Apparatus as recited in claim 1 wherein said inlet is disposed substantially vertically above said knot outlet and wherein said row of rotatable members is formed as a circle, said inlet and knot outlet communicating with the interior of said circle, and said pulp outlet being disposed exteriorly of said circle.

5. Apparatus as recited in claim 1 further comprising a second row of rotable members rotatable about generally vertical axes and forming a second screen with apertures smaller than said knots for separating said knots from said partially digested wood chips and fibers, said first and second screens being spaced from each other.

6. Apparatus for separating knots and other large undigested particles from partially digested wood chips and fibers all of which for the solids portion of a pressurized pulp having a solids content of about 10–15% by weight, comprising:

a chamber, a source of pulp under high pressure of about 150-250 psig disposed on one side of said chamber and connected thereto by an inlet to said chamber, a plurality of rotatable members rotatable about generally vertical axes disposed in said chamber and arranged in a single continuous row across said chamber, said members forming a screen with apertures smaller than said knots for separating said knots from said partially digested wood chips and fibers, said rotatable members comprising intermeshing screw members, means associated with said rotatable members for forcing said knots downwardly to a knot outlet disposed in communication with said inlet on one side of said screen formed by said rotatable members and below said rotatable members adjacent the bottoms thereof, said means comprising helical threads on said screw members, means associated with said rotatable members for preventing the clopping of the apertures therebetween as a result of continued operation of the apparatus, said means comprising a mechanical agitating means disposed in said chamber on the inlet side of said screen and means for sweeping said mechanical agitating means in front of said rotatable member, means for rotating all of said rotatable members in the same direction, and a pulp outlet disposed on the opposite side of said screen formed by said rotatable members as said inlet, the high pressure of about 150–250 psig behind said pulp forcing the portion of said pulp not separated by said screen through said knot outlet, that portion of said pulp separated by said screen passing through the pulp outlet.

* * * * *